United States Patent [19]

Behl

[11] 4,424,043

[45] Jan. 3, 1984

[54] FLOTATION DEVICE

[76] Inventor: Leonard I. Behl, 436 Graystone, Kansas City, Kans. 66103

[21] Appl. No.: 291,623

[22] Filed: Aug. 10, 1981

[51] Int. Cl.[3] ..... B63C 9/10; B63C 9/12

[52] U.S. Cl. ..... 441/81; 441/88

[58] Field of Search ..... 441/74, 81, 122, 40, 441/131, 129, 80, 88; 272/1 B; 114/267; D21/237

[56] References Cited

U.S. PATENT DOCUMENTS

| | | | |
|---|---|---|---|
| D. 110,540 | 7/1938 | Grant et al. | D21/237 |
| D. 161,906 | 2/1951 | Cohen | D21/237 |
| 1,305,606 | 6/1919 | Imaizumi | 441/81 |
| 1,591,074 | 7/1926 | Adams | 441/81 |
| 3,074,084 | 1/1963 | Bisch | 441/131 |
| 3,445,868 | 5/1969 | Frieder et al. | 441/81 |
| 3,520,008 | 7/1970 | Frieder et al. | 441/81 |
| 3,543,315 | 12/1970 | Hoffman | 441/74 |
| 3,616,772 | 11/1971 | Popkin | 114/267 |
| 3,727,252 | 4/1973 | Bauermeister | 441/122 |
| 4,017,927 | 4/1977 | Massey | 441/81 |

FOREIGN PATENT DOCUMENTS

| | | | |
|---|---|---|---|
| 537819 | 1/1956 | Italy | 441/40 |

*Primary Examiner*—Galen L. Barefoot
*Assistant Examiner*—Thomas J. Brahan

[57] ABSTRACT

A water recreational device is the subject of the present invention. The device includes a generally curvilinear flotation member which has an inner section of relatively rigid construction characterized by an ability to support the weight of one or more persons. This section is covered by an outer section of relatively soft resilient material which provides for safety and comfort of a user. The inner section may be formed of relatively rigid foam or a relatively high pressure inflated body. The outer member may be formed of relatively soft resilient foam or may be a relatively low pressure inflated body.

1 Claim, 4 Drawing Figures

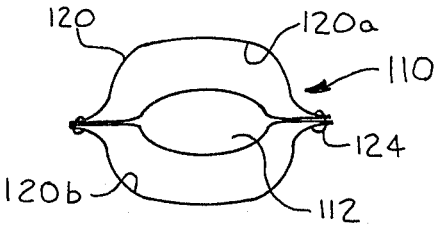
FIG. 3
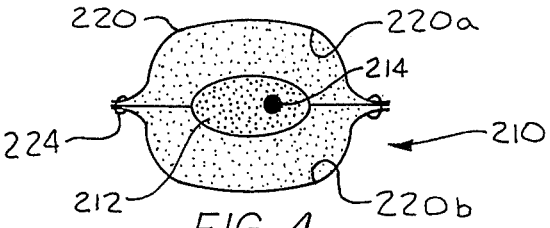
FIG. 4
FIG. 1
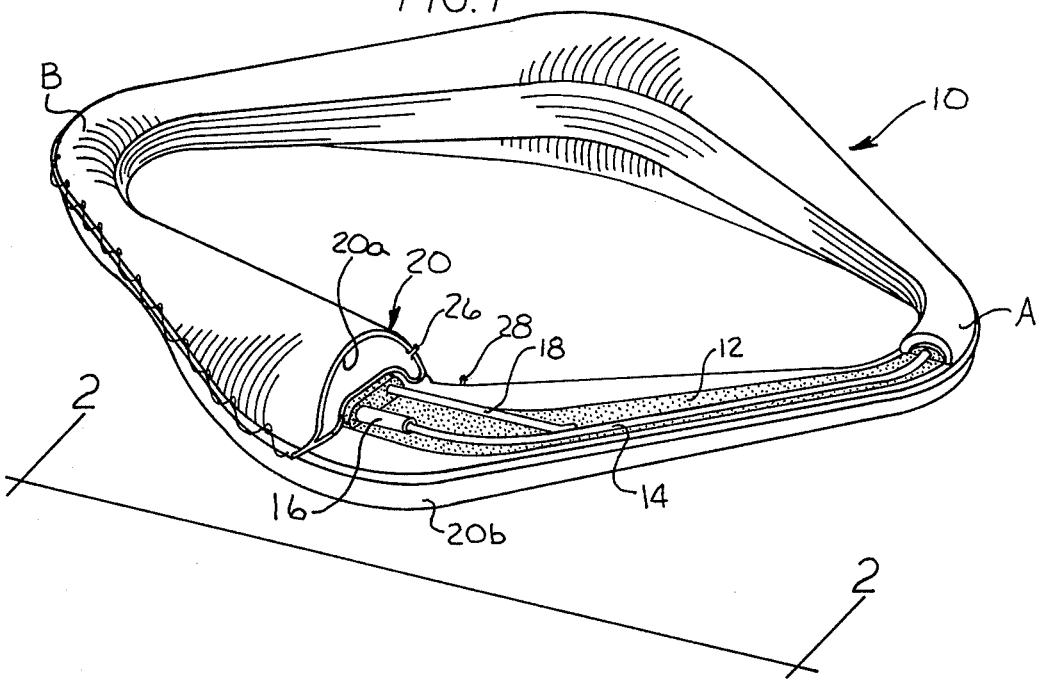
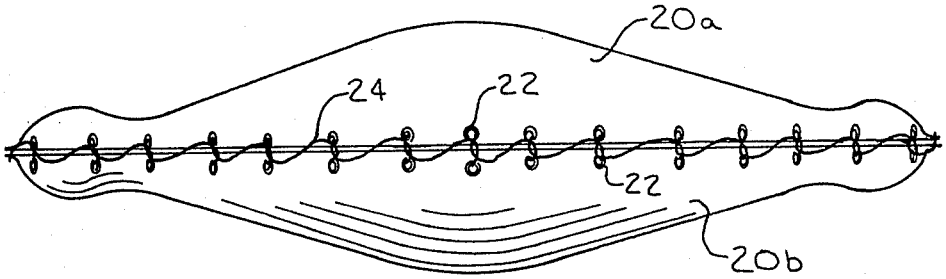
FIG. 2

FLOTATION DEVICE

This invention relates generally to recreational equipment and, more particularly, to a recreational device for use in water.

With increasing emphasis on water recreation, numerous water toys have been introduced in recent years. None of the devices of the prior art have been directed to improving the basic tire inner tube which has long been one of the most popular water flotation devices. The tire inner tube, while being a useful and popular water recreational device, has several inherent limitations. Size is generally too small to accommodate more than one person at a time and it does not have sufficient rigidity to accommodate any type of rocking motion even if more than one person can mount the inner tube.

It is, therefore, a primary object of the present invention to provide a water recreational device having greater size, strength and rigidity than an inner tube but with comparable safety and comfort.

As a corollary to the above object, an important aim of the invention is to provide a water recreational device having a relatively rigid inner section and a relatively soft resilient outer section.

It is a further objective of this invention to provide a water recreational device which can accommodate two or more persons simultaneously and has sufficient strength to support a rocking action by persons on opposite sides of the device.

Still another one of the objects of the invention is to provide a recreational flotation device of the type described which may be constructed from resinous foam material, from a plurality of air inflatable bodies, or from a combination of resinous foam and an air inflatable body.

Still a further object of the present invention is to provide a water recreational device of the type described which may be used in either sea or fresh water.

My invention also has as another one of its principal objects the provision of a water recreational device having greater strength and rigidity than inner tubes but of comparable safety and comfort and having a capacity for use by either children or adults.

Other objects of the invention will be made clear or become apparent from the following description and claims when read in light of the accompanying drawing wherein:

FIG. 1 is a perspective view of the water recreation device of the present invention;

FIG. 2 is an enlarged elevational view looking in the direction of line 2—2 of FIG. 1;

FIG. 3 is a cross-sectional view of an alternative form of the invention; and FIG. 4 is a cross-sectional view of a second alternative form of the invention.

Referring initially to FIG. 1, the device is designated generally by the numeral 10 and assumes a generally curvilinear configuration that is best characterized as a stretched out circle. An inner section 12 is constructed of rigid foam material which is reinforced by rod 14 that extends throughout the length of section 12. A sleeve 16 joins the two ends of rod 14 together in rigid relationship. A cross brace 18 spans the arc presented by rod 14 at one side and an identical cross brace 18 (not shown) is similarly located at the opposite side.

An outer section of device 10 comprises an inflatable body 20 which is presented by two independent air compartments 20*a* and 20*b*. Each compartment is provided with a plurality of eyelets 22 through which a rope 24 is laced to hold the two compartments together.

In use, compartments 20*a* and 20*b* will normally be deflated for periods of extended storage because of the space savings afforded. Valves 26 and 28 are provided for directing air into compartments 20*a* and 20*b*. These valves may be inflated by mouth or through the use of a small pump. When inflated, compartments 20*a* and 20*b* will assume the configuration shown in the drawing. After inflation of the compartments, the device is placed in water where it will float and readily support the weight of two or more persons. A particularly enjoyable use of the device is to place one individual at one end A and another individual at the opposite end B. Because of the relatively strong construction of the device, a rocking action back and forth by the two individuals is possible. The rigid inner section 12 provides the necessary support while the relatively soft resilient outer sections 20*a* and 20*b* provide for comfort and safety for the individuals using the device. Because of the manner of construction, the device is much more serviceable than a conventional inner tube.

Referring now to FIG. 3 of the drawing, an alternative form of the device is designated generally by the numeral 110 and is shown in cross section only. Device 110 would have the same general configuration as device 10 and is comprised of an inner section 112 and an outer section 120 divided into two compartments 120*a* and 120*b*. The two compartments are held together by lacing 124. Device 110 differs from the device 10 aforedescribed in that inner section 112 is also an inflatable compartment which is inflated to a relatively high pressure to provide a rigid structural member. Use of the device 110 occurs in the same manner as the device 10 previously described.

Referring now to FIG. 4 of the drawing, a second alternative device is designated generally by the numeral 210 and comprises an inner section 212 and an outer section 220 formed with two compartments 220*a* and 220*b*. Compartments 220*a* and 220*b* are held together by lacing 224.

Device 210 differs in construction from device 10 previously described only in that outer section 220 is formed from two resilient flexible members 220*a* and 220*b* which are of a soft flexible foam construction. Inner section 212 is formed of rigid foam and reinforced by rod 214 in the same manner as section 12 of device 10. The relatively soft flexible foam which comprises outer section 220 provides the desired safety and comfort which is provided by air compartments 20 and 120 in the other two embodiments.

I claim:

1. A water recreational device comprising:

a generally curvilinear flotation member presenting a stretched out circle having opposite pairs of rounded corners, said member having an inner section comprised of a rigid rod extending the length of said inner section and a cross brace extending parallel to and rigid with said rod at said two opposed corners and a body of rigid resinous foam encasing said rod and said cross braces, said body having a larger cross section at two opposed corners relative to the cross section at the other corners and characterized by an ability to support the weight of at least one person, said member having an outer section overlying said inner section and characterized by first and second inflatable compartments enclosing said inner section and generally following the contour of said inner section, said compartments being joined together.

* * * * *